US008777078B2

(12) United States Patent
Kakuda et al.

(10) Patent No.: US 8,777,078 B2
(45) Date of Patent: Jul. 15, 2014

(54) SAFETY ASSEMBLY FOR A DRIVING TOOL

(75) Inventors: Nobuyuki Kakuda, Anjo (JP); Naoharu Ishikawa, Anjo (JP)

(73) Assignee: Makita Corporation, Anjo (JP)

( * ) Notice: Subject to any disclaimer, the term of this patent is extended or adjusted under 35 U.S.C. 154(b) by 338 days.

(21) Appl. No.: 12/888,738

(22) Filed: Sep. 23, 2010

(65) Prior Publication Data

US 2011/0073630 A1 Mar. 31, 2011

(30) Foreign Application Priority Data

Sep. 25, 2009 (JP) ..... 2009-220313
Dec. 28, 2009 (JP) ..... 2009-297466

(51) Int. Cl.
*B25C 1/00* (2006.01)

(52) U.S. Cl.
USPC ..... 227/8; 227/9; 227/110; 227/120; 227/132; 227/142

(58) Field of Classification Search
USPC ..... 227/8, 9, 110, 120, 132, 142
See application file for complete search history.

(56) References Cited

U.S. PATENT DOCUMENTS 2,780,812 A * 2/1957 Landa et al. ..... 227/8
3,762,620 A * 10/1973 Geist ..... 227/8
4,403,722 A * 9/1983 Nikolich ..... 227/8
5,685,473 A * 11/1997 Shkolnikov et al. ..... 227/8
7,175,063 B2 2/2007 Osuga et al.

FOREIGN PATENT DOCUMENTS

| | | |
|---|---|---|
| EP | 1 642 648 A1 | 4/2006 |
| JP | U-55-089578 | 6/1980 |
| JP | A-2000-334677 | 12/2000 |
| JP | A-2008-173723 | 7/2008 |
| JP | B2-4239731 | 3/2009 |

OTHER PUBLICATIONS

Feb. 6, 2013 European Search Report issued in Europe Application No. 10179487.3-1251.
Sep. 24, 2013 Notification of Reasons for Rejection issued in Japanese Patent Application No. 2009-297466 (with translation).
Feb. 4, 2014 Office Action issued in Japanese Patent Application No. 2009-297466 (with translation).

* cited by examiner

*Primary Examiner* — Michelle Lopez
(74) *Attorney, Agent, or Firm* — Oliff PLC

(57) ABSTRACT

A driving tool is provided in which contact arms of the driving tool are symmetrically arranged at lateral sides of the drive passage, and contact portions of the contact arms are movable between an ON position and an OFF position. Further, the driving tool is configured such that each contact portion is independently movable between the ON position and the OFF position, and when both of the contact portions are moved to the ON position, the driving operation of a drive unit is allowed to operate, and when only one of the contact portions is moved to the ON position, the driving operation of the drive unit is not allowed to operate.

2 Claims, 8 Drawing Sheets

SAFETY ASSEMBLY FOR A DRIVING TOOL

This application claims priority to Japanese patent applications serial numbers 2009-297466 and 2009-220313, the contents of which are incorporated herein by references.

BACKGROUND OF THE INVENTION

1. Field of the Invention

The present invention relates to a driving tool, for example, for driving nails.

2. Description of the Related Art

In driving tools in which compressed air or combustion gases are used as a driving source, efforts have been made to prevent unintended driving operations. For instance, Japanese Patent No. 4239731 shows a technology in which a tip part (a sensing portion, hereafter termed a contact portion) of a contact member termed a contact arm is arranged around an ejection exit and a push of this tip part of the contact arm to a workpiece only causes the tip to be relatively stroked with regard to the ejection exit and a driving operation (for example, a pulling operation of a switch lever) a user has made becomes effective.

In many cases, the above-described contact arm includes an annular part and an actuating arm part. The annular part surrounds a tip of a drive passage (a driver guide) through which a driven member is driven. The actuating arm part extends to a vicinity of a trigger-type switch lever for a driving operation that is made via the annular part. Both the annular part and the actuating arm part are arranged along the lateral side of the driver guide to allow them to stroke.

However, since a known contact arm has a double layer structure in which an annular part is arranged surrounding a tip of a driver guide around an ejection exit, the tip of the driver guide becomes too thick for a user to easily view a driven area on a workpiece. Consequently, a user has to look into the driven area in a cramped position, and thus there has been a problem of hindering visibility and usability of the driving tool.

Thus, there is a need to present a driving tool equipped with a contact arm that does not hinder visibility of a driven area at the time of driving.

SUMMARY OF THE INVENTION

To this end, the present invention provides driving tools as follows.

One construction for a driving tool can include a contact arm whose contact portion moves along an axis line different from that of an ejection exit, and the contact portion is arranged offset laterally for replacing a conventional method in which the contact portion surrounds the ejection exit, which can prevent damage of visibility of the driving part which is caused by the contact portion of the contact arm, and thus a user can look into the driving part in a comfortable condition to effectively perform a driving operation.

According to another construction, it is possible to enable the contact arm corresponding to a mode of operation. For example, an ON operation is effective when one of the right and left contact portions moves to an ON position, or when both right and left contact portions moves to the ON position.

According to another construction, an oblique driving can be done while the driving tool is located obliquely with respect to the workpiece, because when one of the right and left contact portions moves to the ON position, the other contact portion moves to the ON position together.

According to another construction, a pair of contact portions can move independently between an ON position and an OFF position, and even if one of the contact portions moves to the ON position, an ON operation by a user is not effective and a driving operation cannot be done while the other contact portion is held in the OFF position. Only when both right and left contact portions move to the ON position together, an ON operation by the user is effective and a driving operation can be done. Consequently, an oblique driving can be prohibited in which one of the contact portions moves to the ON position and the other contact portion is held in the OFF-position. Only when the driving tool is pressed to the workpiece vertically and both contact portions are moved to the ON position at the same time, an ON operation by a user is effective and a driving operation (a vertically driving) can be done.

In addition, even when a structure is adopted in which a pair of contact portions can moves independently between the ON position and the OFF position, it may possible to construct an oblique driving in which only one of the contact portions moves to the ON position and an ON operation by a user can be effective.

According to another construction, the contact portion of the contact arm is movably supported between the ON position and the OFF position inside a guide tube that is provided at a tip of the driver guide. An inner circumference hole of this contact portion serves as a part of a drive passage, and thus a tip of the inner circumference hole of the contact portion serves as an ejection exit and driven members are driven through the hole. Compared to a known structure in which the contact arm is arranged surrounding an outer circumference of the driver guide that includes the ejection exit, deterioration of visibility of the ejection exit, which is caused by the contact portion, can be diminished.

According to another construction, a connection of the contact portion to the main body part is made via an actuating bar, and thus by minimizing a range (a size) of the annular contact portion and constructing the guide tube size to the minimum in a axial direction, a compactification around the driver guide can be achieved and visibility of the ejection exit of driven members can be greatly improved.

According to another construction, by utilizing a movement of the contact arm, a so-called blank driving can be prevented, and thus a compactification of the driver guide and a structure around a driving magazine can be achieved and also the driving tool can include the blank driving prevention function.

According to another construction, a connection of the contact portion to the main body part can be made by the actuating bar and also a size of the contact portion can be made minimum necessary, and a blank driving can be prevented by utilizing the movement of the contact portion via s contact bar. Thus, a compactification of the driver guide and a structure around the driven member magazine can be achieved and visibility of the ejection exit of driven members can be greatly improved.

DETAILED DESCRIPTION OF THE INVENTION

Each of the additional features and teachings disclosed above and below may be utilized separately or in conjunction with other features and teachings to provide improved driving tool. Representative examples of the present teaching, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful examples of the present teachings.

Figure 1:
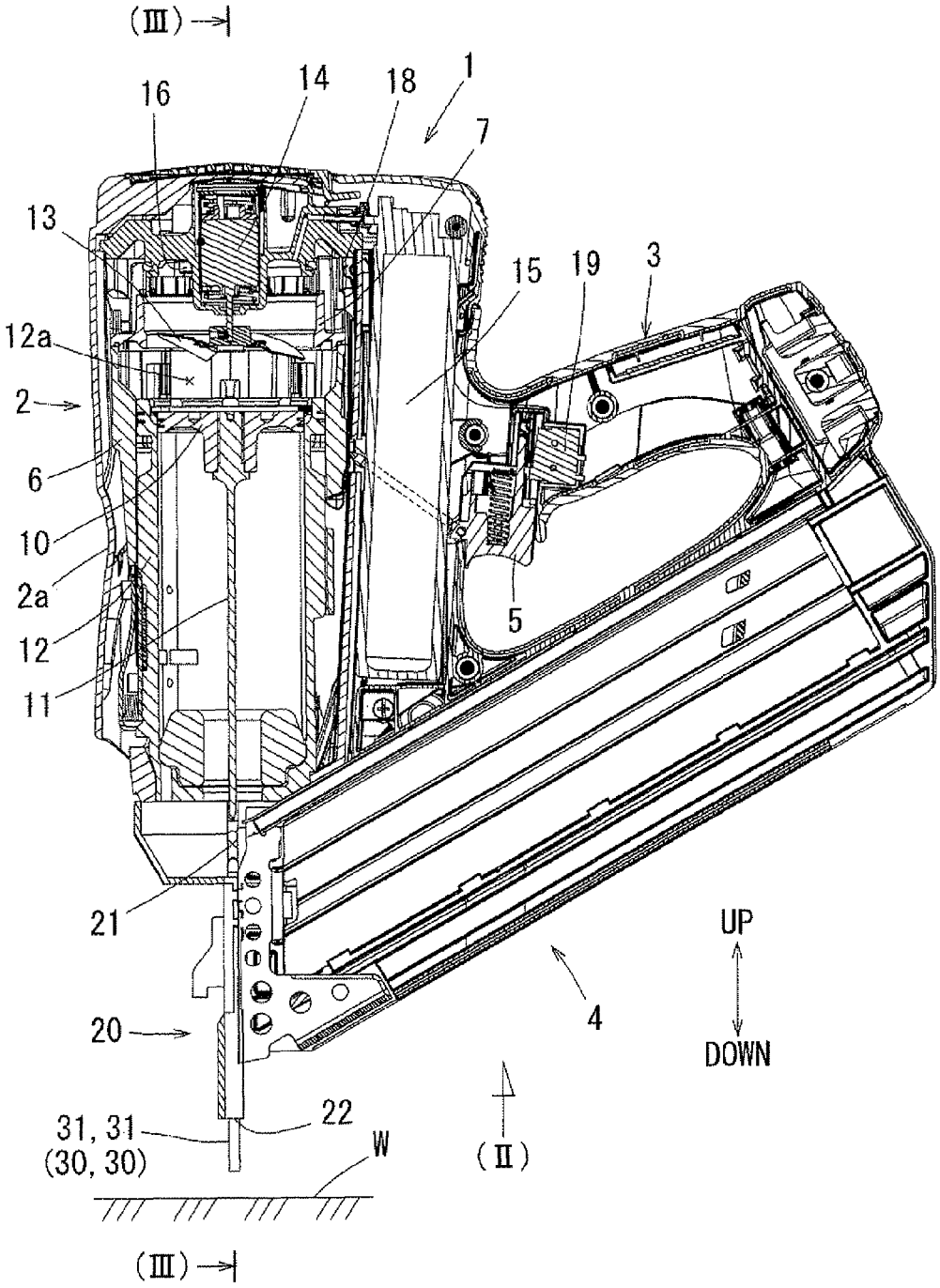
FIG. 1 is a longitudinal cross-sectional view of a driving tool according to an embodiment.
Figure 2:
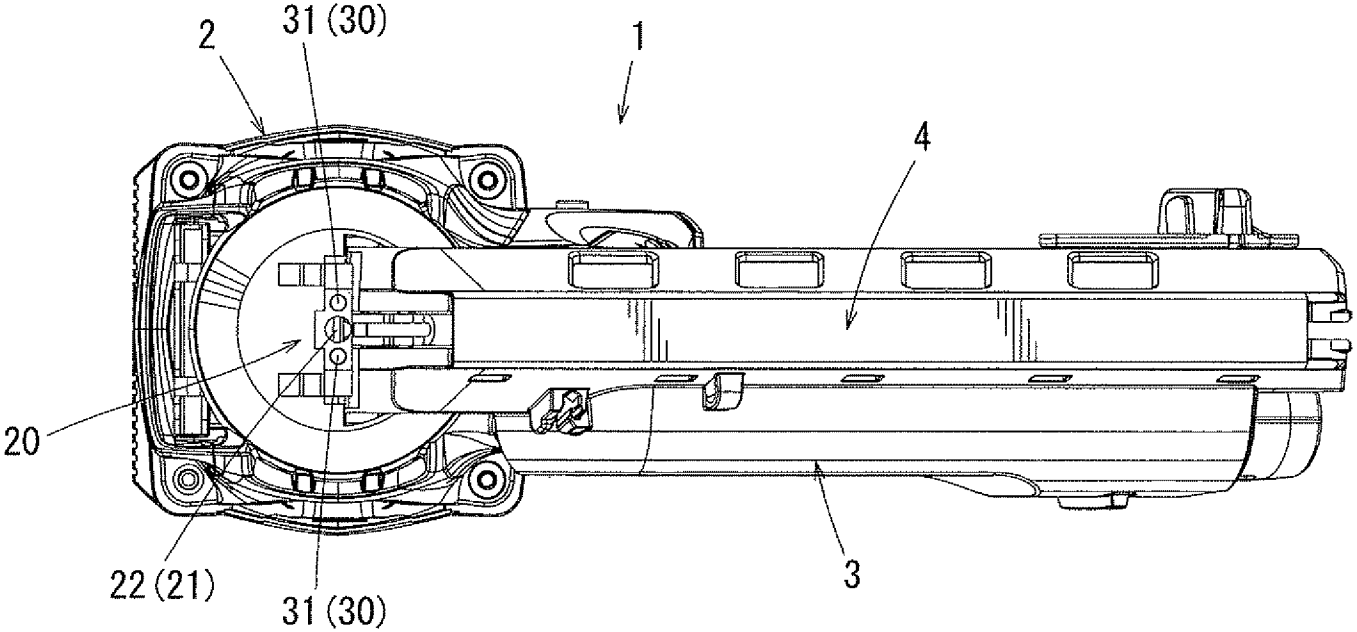
FIG. 2 is a bottom view of the driving tool viewed along arrow (II) in FIG. 1.

Next, an embodiment will be described with reference to FIG. 1 to FIG. 4. FIG. 1 shows a driving tool 1 of one embodiment. The embodiment illustrates a gas-combustion-type nail driver as a driving tool 1 in which a thrust force obtained by burning combustible gases (combustion gases) is used as a driving force. The embodiment explained below is characterized in a contact arm 30 for preventing an unintended malfunction of the driving tool 1, and a basic configuration of the driving tool 1 is almost the same as that of a known art and requires no particular changes, and thus a detailed explanation of the basic configuration will not be included.

The driving tool 1 includes a main body part 2 in which a piston 10 reciprocated by a thrust force of combustion gases is accommodated, a driver guide 20 extending from a bottom part of the main body part 2 to a lower side (forward in a driving direction), a handle part 3 extending laterally from a lateral part of the main body part 2, and a driven member magazine 4 extending from a tip of the handle part 3 to the driver guide 20.

The piston 10 is accommodated in a cylinder 12 of the main body part 2. An elongated plate-like driver 11 is attached extending downwardly from a lower surface of the piston 10 to drive driven members n (refer to FIG. 3 and FIG. 4). A lower side of the driver 11 proceeds into a drive passage 21 of the driver guide 20. The drive passage 21 is provided along an axis line J22 that is approximately in the center of the driver guide 20. A driven members n are supplied one by one from the driving magazine 4 into the drive passage 21. A lower end part of the drive passage 21 is referred to as an ejection exit 22 from which the driven members n are driven. Therefore, the above axis line J22 represents a driving axis of the ejection exit 22. The driven member n are driven out of the ejection exit 22 by being hit by the driver 11 that moves downward to be driven into the workpiece W into which the driven members are driven.

An upper part of the cylinder 12 is a combustion chamber 12*a* that is located in an upper part of the main body part 2. The combustion chamber 12*a* opens or closes by upward or downward displacement of a combustion valve 7. A mixing fan 13 is arranged within the combustion chamber 12*a* in order to mix supplied combustible gases and air. The mixing fan 13 rotates by a fan motor 14. The fan motor 14 activates when a fan switch 18 is turned on. A combustible gas is supplied by increments from a cassette gas cylinder 15. Further, an ignition plug 16 is arranged in the combustion chamber 12*a*. When a trigger type switch lever 5 located at a base of a handle part 3 is pulled by a fingertip operation while the combustion chamber 12*a* is being closed by the combustion valve 7, the ignition switch 19 is turned on and a spark is generated from the ignition plug 16. The piston 10 moves downward to a driving direction (in a downward direction in FIG. 1) by a thrust force generated by an instant combustion of combustible gases by the spark of the ignition plug 16. When the piston moves downward, the driven member n is hit by a lower part of the driver 11 to be driven out of the ejection exit 22.

Figure 3:
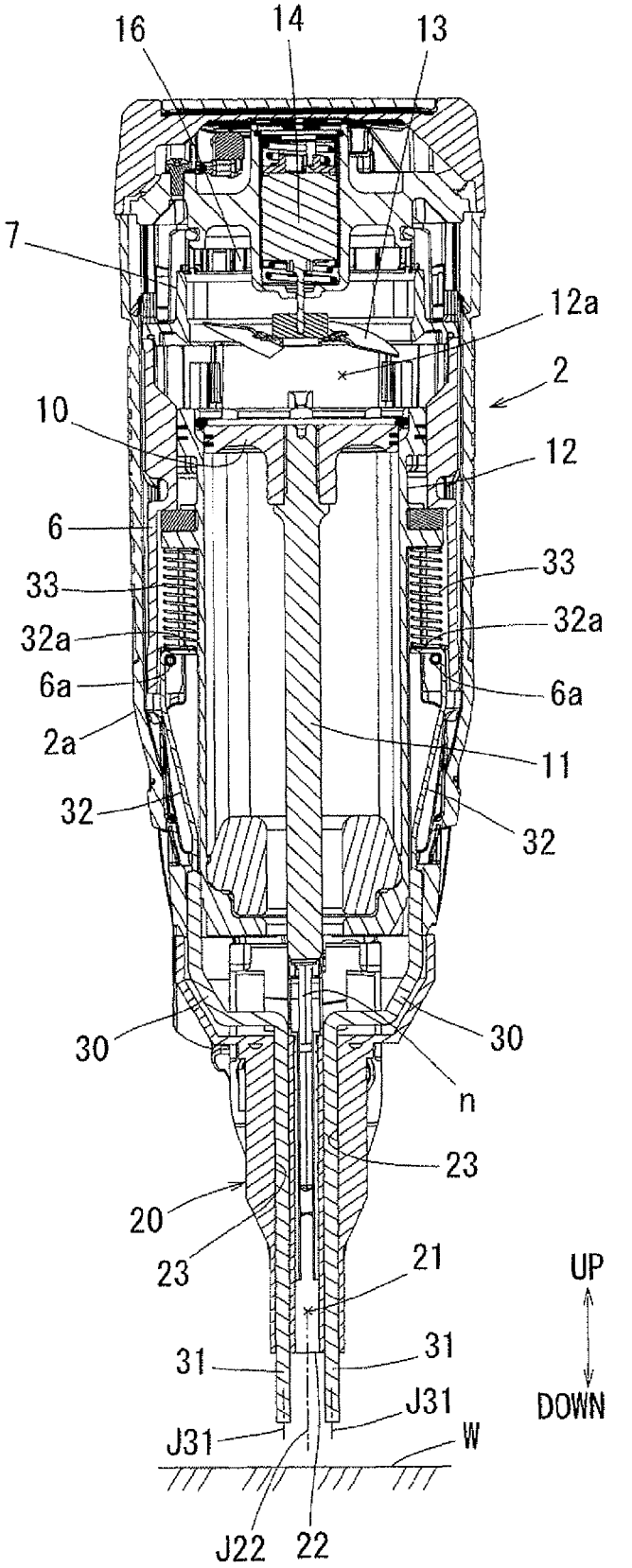
FIG. 3 is a cross-sectional view of the driving tool taken from line (III)-(III) of FIG. 1. This figure shows a state in which a contact arm is located at an OFF position.
Figure 4:
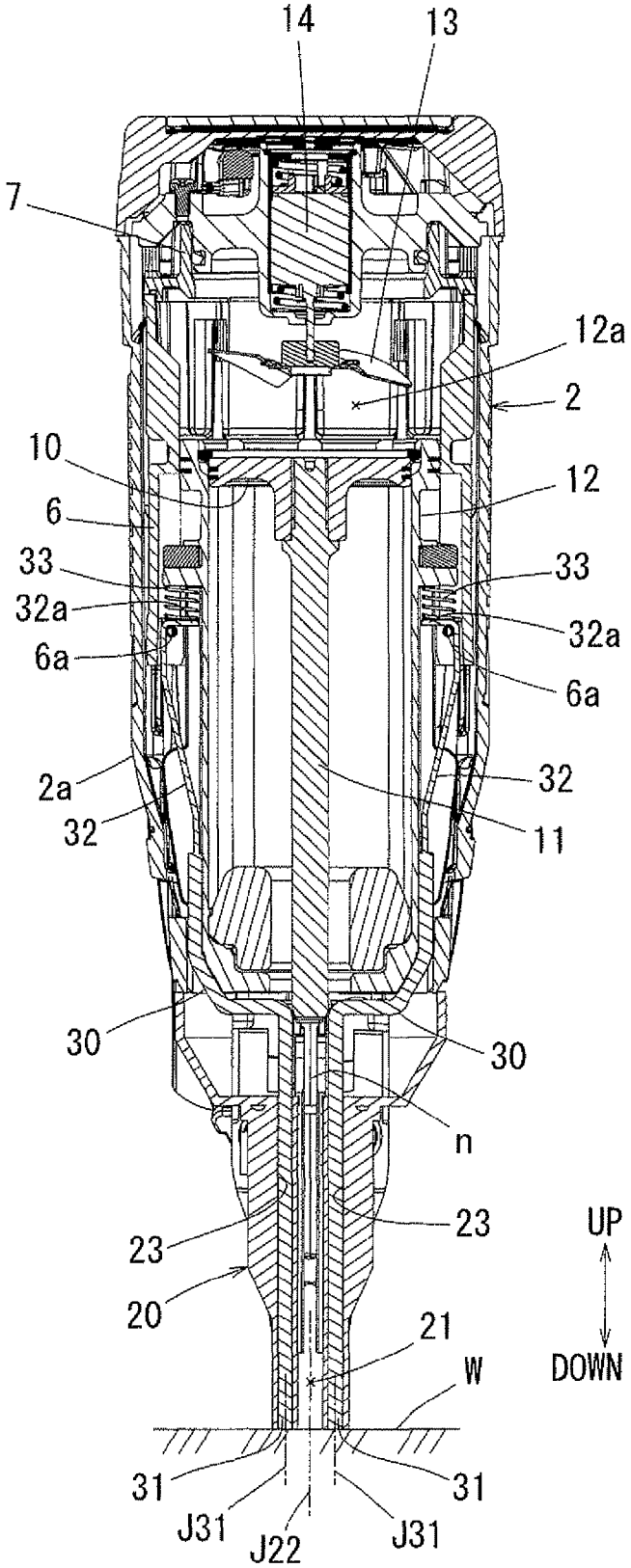
FIG. 4 is a cross-sectional view of the driving tool taken from line (III)-(III) of FIG. 1. This figure shows a state in which the contact arm is located at an ON position.

An ON operation of the contact arm 30 is required to perform the driving operation. In one embodiment, two contact arms 30, 30 are symmetrically arranged along the drive passage 21, as shown in FIG. 3 and FIG. 4. In the embodiment, the contact arm 30, 30 are manufactured based on thin bars.

Figure 5:
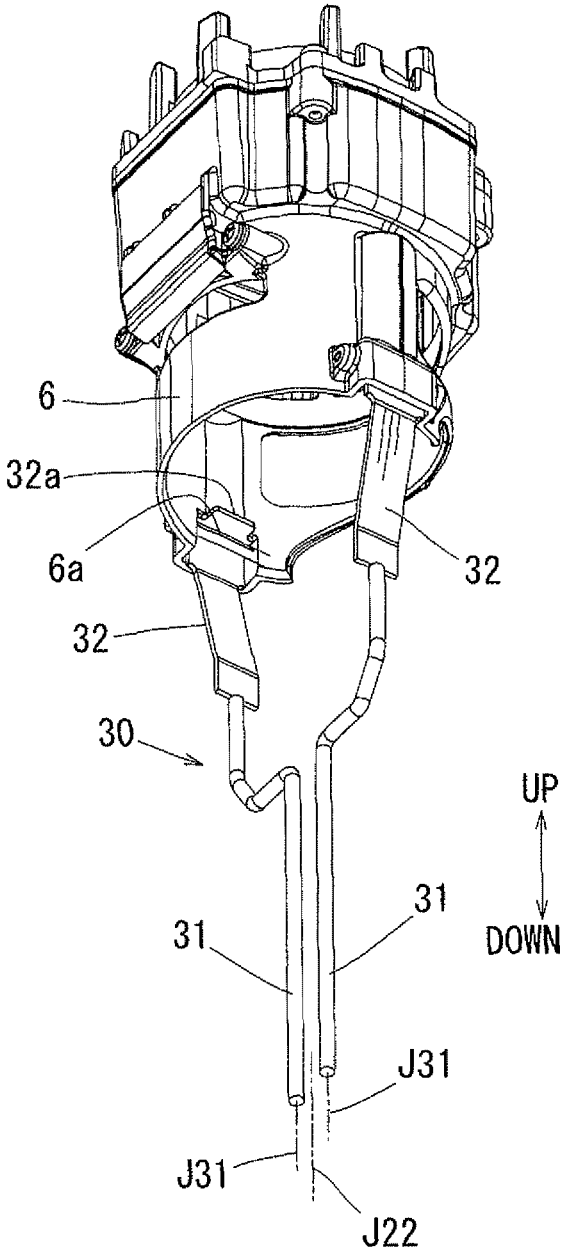
FIG. 5 is a perspective view of an assembly part that includes a contact arm and a movable cylinder.

Supporting holes 23, 23 are provided in the driver guide 20 along both right and left sides of the drive passage 21 located at the center of the driving guide 20. Both supporting holes 23, 23 are provided parallel to one another along the drive passage 21. Each contact arm 20 is horizontally and movably supported in the corresponding supporting holes 23, 23. As shown in FIG. 3 to FIG. 5, each contact arm 30, 30 is bent at nearly the middle of the arm in the longitudinal direction, and each straight part below the bent part is inserted through the supporting hole 23. A lower end part of the straight part is referred to as a contact portion 31, protruding from each side of the ejecting exit 22 to the driving direction. In this way, both contact portions 31, 31 are movably supported along axial lines J31, J31 that are different from the driving axis line J22 of the ejection exit 22. And thus, the contact portions 31, 31 are movably supported between an ON position and an OFF position, being offset horizontally with regard to the ejection exit 22.

Each L-shaped bent part that is an upper part of the contact arms 30, 30 proceeds into a housing 2*a* of the main body part 2. An actuating bar 32, 32 is connected to an upper end part of each contact arm 30. An upper end part of both actuating bars 32, 32 is bend in a L-shaped way. The L-shaped bent part 32*a* is linked to an engaging part 6*a* of a movable cylinder 6. The movable cylinder 6 is vertically and displaceably supported in an outer circumference of the cylinder 12. A combustion valve 7 is connected to an upper part of the movable cylinder 6. Vertical movement of the movable cylinder 6 causes the combustion valve 7 to displace together, and also causes the combustion chamber 12*a* to open or close.

Both contact arms 30, 30 displaces vertically together with the movable cylinder 6, and both contact arms 30, 30 displace together. A compressed spring 33 is inserted between the bent part 32*a* and a flange part provided in an outer circumference of the cylinder 12. The movable cylinder 6 and both contact arms 30, 30 are biased downward by the compressed spring 33, 33.

Further, since each contact arm 30 is biased downward by the corresponding compressed springs 33, both contact portions 31, 31 extrude from the supporting hole 23, being biased to the OFF position side in which the contact portions extrude forward over the ejection exit 22. FIG. 3 shows a condition in which both contact portions 31, 31 are set to the OFF position. FIG. 4 shows a condition in which both contact portions 31, 31 are set to the ON position showing the contact portions are housed in the supporting holes 23, 23 against the compressed spring 33, 33.

When the contact portions 31, 31 of the contact arm 30 are pressed to the workpiece W and relatively displaced upward prior to a driving operation of the drive unit, the movable cylinder 6 and the combustion valve 7 are moved upward together in conjunction with the displacement of the contact portions. Then, the combustion chamber 12*a* is airtightly closed and a driving operation is made by a pull operation of the switch lever 5.

Unless the contact portions 31, 31 of the contact arms 30, 30 are not pressed to the workpiece W to displace upward, a pull operation of the switch lever 5 is ineffective and a driving operation cannot be performed because a combustion chamber 12*a* is not closed. In this way, the main body part 2 includes the housing 2*a* and the other members, such as the piston 10, the movable cylinder 6, the driver 1 etc., and the driving operation is performed by a drive unit including the combustion chamber 12*a*, the movable cylinder 6, and the piston 10.

According to the construction described above, the contact portion 31 of the contact arm 30 for enabling the pull operation of the switch lever 5 differs from a known art in which the contact portions surround the ejection exit and is movably disposed between the ON position and the OFF position along the axis line 731 that is offset horizontally with respect to the center of the drive passage 21 surrounding the ejection exit 22. Consequently, deterioration of the visibility of the driven part on the workpiece W caused by the contact portions 31, 31 can be prevented more than in prior devices, and a user can easily view the driven part in a comfortable position to efficiently perform an driving operation.

Further, a pair of contact arm 30, 30 is constructed to link to the movable cylinder 6 and to move vertically together with the movable cylinder 6. Therefore, when one of the contact portions 31 moves to the ON position, the other contact portion 31 moves to the ON position at the same time. Thus, an oblique driving can be performed in which the driving tool is obliquely set with respect to the workpiece W.

Further, the structure described above differs from prior devices because the contact portion is formed in an annular double structure in which the contact portion surrounds the ejection exit, but is such that, for example, a thin bar type contact portion is disposed being offset laterally with respect to the ejection exit. Therefore, a tip part of the driver guide near the ejection exit can be configured to be thin. Thus, a driving operation to a small area, such as a bottom surface of a wall base sheet (C-type channel material), can be efficiently performed.

Various modifications can be made to the embodiment described above. The structure for enabling an oblique driving has been illustrated such that a right and a left contact portion 31, 31 are moved together in order that when one of the contact portions is pressed to the workpiece W and moves to the ON position, the other contact portion 31 moves to the ON position together to enable a pulling operation of the switch lever 5 to be effective. However, it is also contemplated to provide a configuration in which a right and a left contact portions 31, 31 can move independently. For example, in a compressed-air-driving-type driving tool, oblique driving can be prohibited by adopting a configuration in which an ON position can only be achieved when both the contact arms, which are movable independently, moves to the ON position at the same time. Thus, a pulling operation of the switch lever can be effective with respect to a trigger valve to enable a driving operation to be performed.

Further, the structure in which a right and a left contact arms 30, 30 are coupled at the lower end sides via the movable cylinder 6 has been illustrated, but both contact arms can be constructed to be linked at the tip end side (a contact portion side) to move together. For example, though not shown in the figure, a construction may be possible such that an annular ring plate is attached between a right and a left contact portion 31, 31 to enable both contact portions 31, 31 to move together. Even in this structure, when both contact portions 31, 31 are located at the OFF position, a driven area can be viewed via an inner circumference of the ring plate, and thus, the driven area can be highly visible as compared to the prior devices.

Further, the construction has been illustrated in which a right and a left contact portions 31, 31 are arranged in respect to the ejection exit 22, but a configuration where only one of a right and a left contact portions is arranged is contemplated.

Further, as a driving tool, a gas combustible driving tool is shown, but the same construction can be applied to a driving tool in which a compressed air is used as a driving source.

Figure 6:
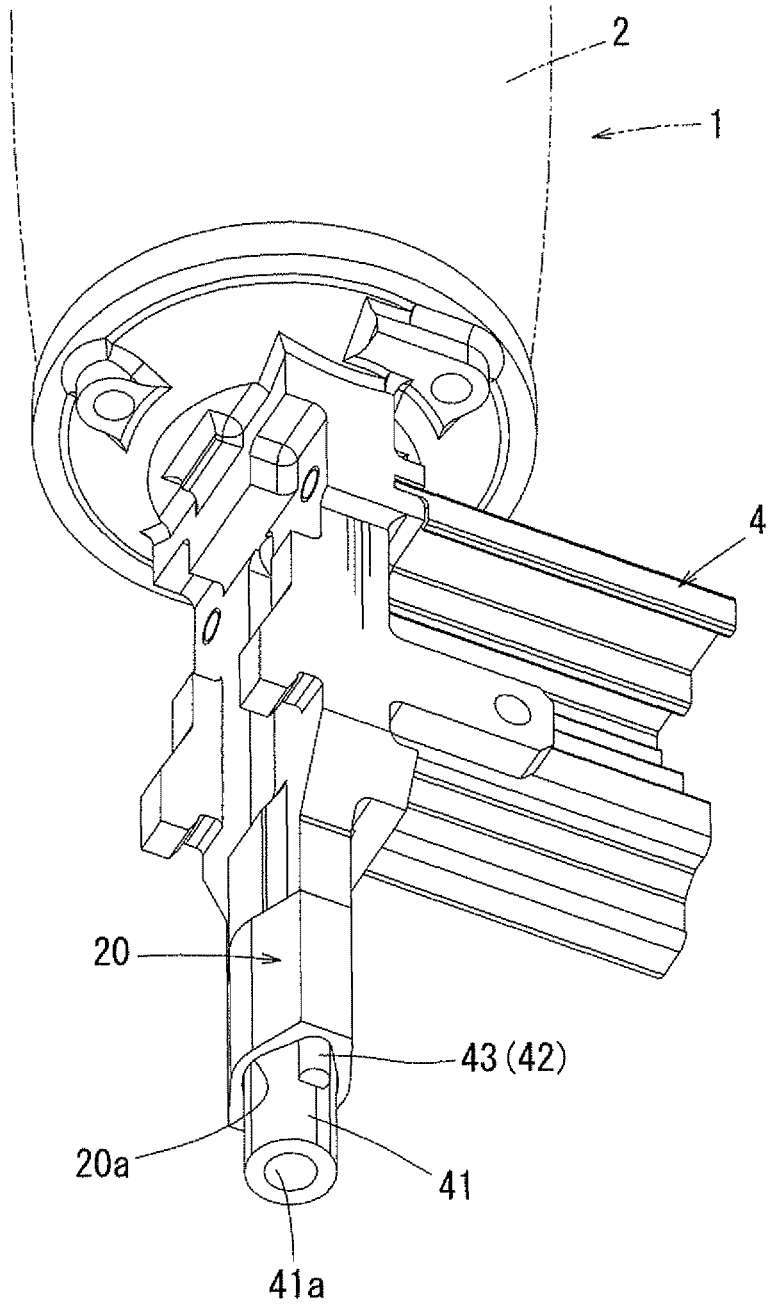
FIG. 6 is a perspective view of a circumference of a driver guide, and shows a tip part of the driving tool of another embodiment.
Figure 7:
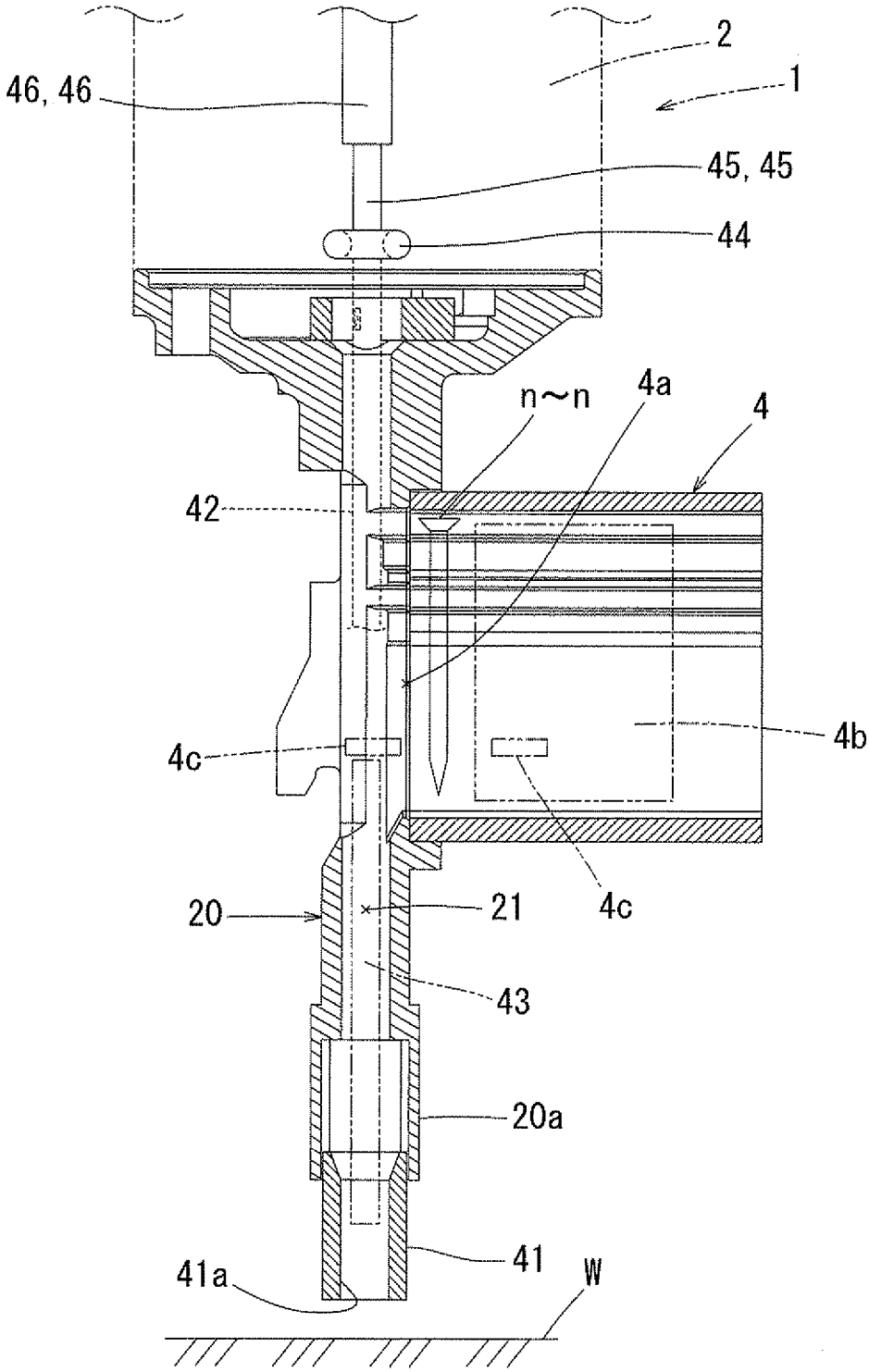
FIG. 7 is a side view of the circumference of the driver guide, and shows the tip part of the driving tool of another embodiment.
Figure 8:
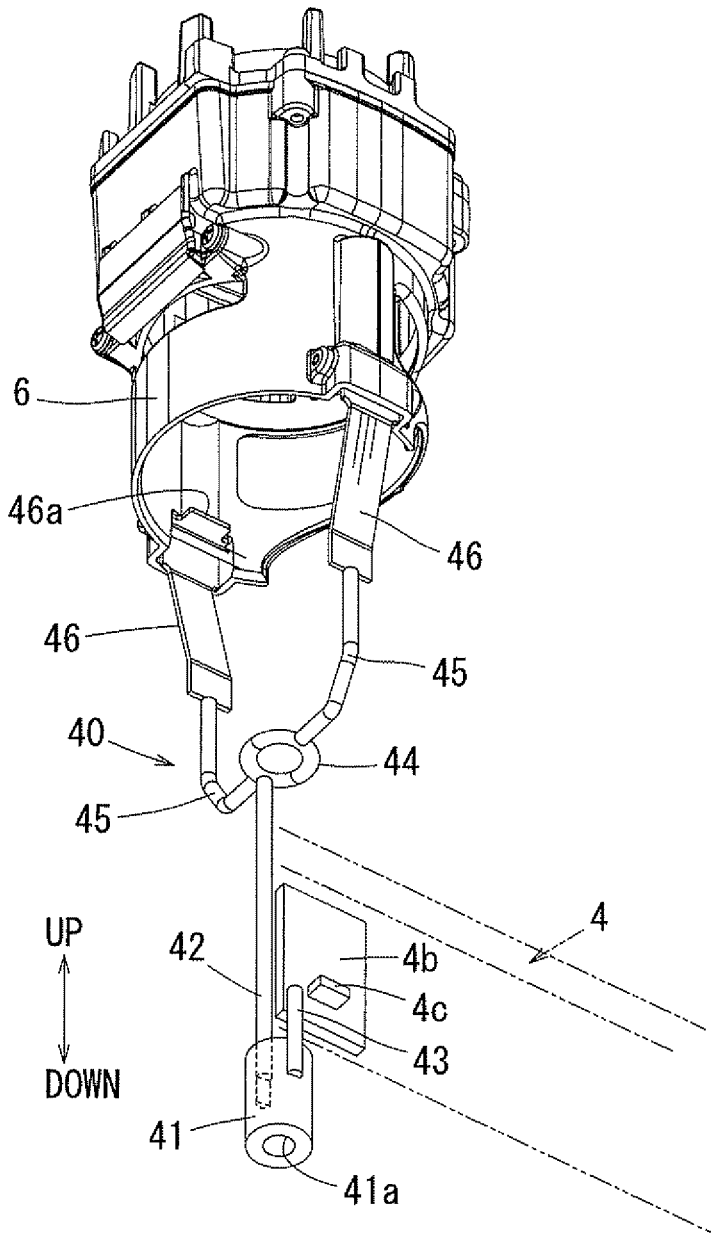
FIG. 8 is a perspective view of an assembly part that includes a contact arm and a movable cylinder according to another embodiment.

Next, FIG. 6 to FIG. 8 shows a contact arm 40 according to another embodiment. The contact arm 40 according to the embodiment is included in the same gas-combustible type nail driver (the driving tool 1) as in the former embodiment. Regarding the same members or structure as those of the driving tool 1 in the former embodiment, the same numberings as those in the former embodiment are used and the figures and explanation are omitted. The construction of the contact portions 41 of the contact arm 40 in the embodiment differs from that of the former embodiment.

The contact arm in the embodiment includes a tubular cylindrical contact portion 41. In a tip end of the driver guide 20, a guide tube 20*a* is provided whose inner diameter is larger than the drive passage 21. A contact portion 41 is supported inside the inner circumference of this guide tube 20*a*, being movable vertically along a driving direction. An OFF position of the contact portion 41 is a position in which the contact portion 41 protrudes with respect to the guide tube 20*a* in the driving direction, while an ON position is a position in which the contact portion 41 does not protrude. FIG. 6 and FIG. 7 show the OFF position of the contact portion 41. An inner circumference hole 41*a* of the contact portion 41 serves as a part of a tip end part of the drive passage. Thus, a tip of the inner circumference 41*a* of the contact portion 41 serves as an ejection exit.

An actuating bar 42 and a contact bar 43 are provided at a right and a left side of the contact portion 41, respectively. The actuating bar 42 and the contact bar 43 extend upward along the drive passage 21. As shown in the figure, the actuating bar 42 extends further than the contact bar 43. Via the actuating bar 42 that extends upward, the contact portion 41 is linked to the movable cylinder 6 of the main body part 2. An upper end part of the actuating bar 42 is linked to the annular link ring 44. A driver 11 passes through the link ring 44.

Two intermediate bar 45, 45 extend upward and symmetrically from the right and left side of the link ring 44 in a L-shaped way. The upper end part of both the intermediate bars is linked to a lower end part of the actuating plate 46, respectively. The right and left actuating plates 46, 46 correspond to the actuating plates 32, 32 of the movable cylinder 6, and a L-shaped upper bent part 46*a* is linked to the right and left sides of the movable cylinder 6. And thus, the contact arm 40 moves vertically together with the movable cylinder 6, as well as in the former embodiment. When the movable cylinder 6 moves vertically, the combustion valve 7 vertically moves together and the combustion chamber 12*a* opens or closes. Further, compressed springs 33, 33 are inserted between the actuating plates 46, 46 and the cylinder 12, as well as in the former embodiment. The movable cylinder 6 and the contact arm 40 are biased (a downward direction in the figure) in the driving direction by the compressed springs 33, 33. Therefore, the contact arm 40 is biased to the OFF position.

The other contact bar 43 that is a shorter one has such length as the upper end part of the contact bar 43 is located proximate to a feed opening 4*a* of the driven member magazine 4. In the present embodiment, the contact bar 43 serves to prevent a so-called blank driving. A driving magazine 4 protruding laterally from the driver guide 20 includes a pusher plate 4*b* for pushing loaded driven members n to the side of the drive passage 21. Though not shown in the figure, this pusher plate 4*b* is biased to a supplying side of the driven members (a leftward direction in FIG. 7) by a biasing means such as a winded spring. The pusher plate 4*b* pushes loaded driven members n to the side of the drive passage 21, and a driven member n is supplied one by one into the drive passage 21.

A restriction protrusion part 4*c* is provided in the pusher plate 4*b*. When there is no driven member n in the magazine 4, the pusher plate 4*b* proceeds into the drive passage 21 and the restriction protrusion part 4*c* proceeds behind the contact bar 43 in the driving direction. And thus, an upward displacement of the contact bar 43 is prohibited by the restriction protrusion part 4*c*. Since an upward displacement of the contact bar 43 is prohibited, a push operation of the contact portion 41, which is linked to the actuating bar 42, and also a push operation of the contact arm 40 to the ON position is prohibited. When a push operation of the contact arm 40 to the ON-position is prohibited, the movable cylinder 6 and the combustible valve cannot move upward. Thus, an ON operation by a user becomes ineffective and a driving operation is not performed by the driver unit. In this way, a so-called blank driving can be prevented.

When a driven member n is supplied in the drive passage 21, a restriction protrusion 4*c* of the pusher plate 4*b* does not proceed to an upper side of the contact bar 43 and an upward displacement of the contact bar 43 is possible. Therefore, a push operation of the contact arm 40 to the ON position closes the combustion chamber 12*a*, and a driving operation can be performed by an ON operation of the user.

According to the construction as described above, the contact portion 41 of the contact arm 40 is not located outside of the guide tube 20*a* provided at the tip of the driver guide 20, but inside thereof. Therefore, visibility of the tip of the driver guide 20 is not obstructed.

Further, the construction includes a double annular structure having the contact bar 41 and the guide tube 20*a* around the outer circumference of the contact bar 41, and the inner circumference hole 41*a* of the contact portion 41 serves as the drive passage 21 and also the bottom end part of the inner circumference hole 41*a* serves as the ejection exit from which the driven member n is driven out. In this respect, visibility of the ejection exit is not obstructed.

Further, regarding the actuating bar 42 and the contact bar 43 that support the contact portion 41 of the contact arm 40, it is possible that only the contact bar 43 serves to prevent the blank driving. And thus, a blank-prevention mechanism and a compactification of the contact arm 40 can be obtained, which aids in the operability and efficiency of use of the driving tool.

Various modifications can be made to the construction described above. The construction shows that the actuating bar 42 is provided at one of the right and left side of the contact portion 43 and the contact bar 43 is provided at the other side, showing that an upward displacement of the contact bar 43 is prohibited by the restriction protrusion 4*c* of the pusher plate 4*b*, which can prevent a blank driving. This construction can be changed, in that actuating bars 42, 42 provided symmetrically at both sides of the contact portion 41 are linked to the corresponding actuating bar 42, 42 to further link the main body 2 without using the link ring 44, and that another means to prevent the blank driving can be adopted without using the contact bar 43.

Further, it is possible that actuating bars 42 are provided symmetrically at both sides of the contact portion 41 and the above-described contact bar 43 is also provided at a lateral side of the contact portion 41 in order to prevent the blank driving.

FIG. 7 shows that the size of the outer diameter of the guide tube 20*a* is larger than that of the parts other than the driver guide 20, but this configuration is not absolutely necessary. It is possible that the guide tube 20*a* has the same thickness as the other parts and the size of the inner diameter of the guide tube 20*a* becomes large as possible to be able to accommodate the contact portion 41.

Further, as well as in the former construction, the contact arm 40 of the latter construction can be applied not only to a gas-combustible driving tool 1 but also to air-compressed driving tools. In addition, nails are exemplified as the driven members, but the driven members may be rivets, fixing pins, clips, or fasteners.

We claim:

1. A driving tool comprising:

a drive unit;

a driver driven by the drive unit configured to be moved in a driving direction;

a driver guide defining therein a drive passage of a driven member and having an end portion configured to guide the driver and having a drive opening at one end in a driving direction, the drive opening having a first axis; and a contact arm having a contact portion in the shape of a hollow tube movable between a first position and a second position, wherein:

the contact portion in the first position does not protrude beyond the end portion of the driver guide and permits a driving operation of the drive unit;

the contact portion in the second position protrudes beyond the end portion of the driver guide and inhibits the driving operation of the drive unit;

the end portion of the driver guide includes a guide tube having an inner diameter larger than an inner diameter of the drive passage;

the contact portion moves within the guide tube between the first position and the second position; and the contact portion has an inner circumference hole serving as a part of the drive passage of the driven member;

a driven member magazine is provided in the driver guide and is configured to house a plurality of driven members and supplying a driven member one by one to the drive passage;

an actuating bar is coupled to one of the right and left side of the contact portion and a contact bar is coupled to the other side of the contact portion, the contact portion being coupled to the contact arm via the actuating bar; and the contact bar is configured to prevent a blank driving, the contact bar permitting the contact portion to move to the first position only when driven members are supplied from the driven member magazine to the drive passage.

2. A driving tool comprising:

a drive unit;

a driver driven by the drive unit configured to move in a driving direction;

a driver guide defining therein a drive passage and having an end portion configured to guide the driver and having a drive opening at one end in a driving direction, the drive opening having a first axis;

a contact arm having a contact portion movable between a first position and a second position, a driven member magazine provided in the driver guide configured to house a plurality of driven members and supplying a driven member one by one to the drive passage; and an actuating bar coupled to one of the right and left side of the contact portion and a contact bar coupled to the other side of the contact portion, the contact portion being coupled to the contact arm via the actuating bar, wherein:

the contact portion in the first position does not protrude beyond the end portion of the driver guide and permits a driving operation of the drive unit;

the contact portion in the second position protrudes beyond the end portion of the driver guide and inhibits the driving operation of the drive unit;

the end portion of the driver guide includes a guide tube having an inner diameter larger than an inner diameter of the drive passage;

the contact portion moves within the guide tube between the first position and the second position;

the contact portion has an inner circumference hole serving as a part of the drive passage; and the contact bar is configured to prevent a blank driving, the contact bar permitting the contact portion to move to the first position only when driven members are supplied from the driven member magazine to the drive passage.

* * * * *